US005584666A

United States Patent [19]

Kozumplik, Jr. et al.

[11] Patent Number: 5,584,666

[45] Date of Patent: Dec. 17, 1996

[54] REDUCED ICING AIR VALVE

[75] Inventors: Nicholas Kozumplik, Jr.; Robert C. Elfers, both of Bryan, Ohio

[73] Assignee: Ingersoll-Rand Company, Woodcliff Lake, N.J.

[21] Appl. No.: 324,201

[22] Filed: Oct. 17, 1994

[51] Int. Cl.[6] ..... I04B 49/00; I04B 43/06

[52] U.S. Cl. ..... 417/46; 417/393; 417/395; 91/313; 91/315; 91/281; 137/102

[58] Field of Search ..... 417/46, 395, 393; 91/281, 286, 287, 291, 304, 310, 313, 314, 315, 468; 137/102, 625.64

[56] References Cited

U.S. PATENT DOCUMENTS

| | | | |
|---|---|---|---|
| 3,304,126 | 2/1967 | Rupp et al. | 417/395 |
| 3,791,768 | 2/1974 | Wanner | 417/395 |
| 3,838,946 | 10/1974 | Schall | 417/395 |
| 3,850,082 | 11/1974 | Nussbaumer | 137/102 |
| 4,524,803 | 6/1985 | Stoll et al. | 137/625.64 |
| 4,854,832 | 8/1989 | Gardner et al. | 417/395 |
| 5,232,352 | 8/1993 | Robinson et al. | 417/393 |
| 5,277,555 | 1/1994 | Robinson | 417/393 |
| 5,326,234 | 7/1994 | Versaw et al. | 417/395 |

*Primary Examiner*—Timothy Thorpe
*Assistant Examiner*—Xuan M. Thai
*Attorney, Agent, or Firm*—Walter C. Vliet

[57] ABSTRACT

Provision is made for an air control valve to bypass the ice forming exhaust of a reciprocating pressure activation chamber in a reciprocating double diaphragm pump utilizing the supply pressure to close a check valve in line between the valve and the chamber which is then opened to exhaust by exhaust fluid flow from the chamber.

10 Claims, 4 Drawing Sheets

REDUCED ICING AIR VALVE

BACKGROUND OF THE INVENTION

This invention relates generally to air valves and more particularly to an air valve designed to minimize icing and improve efficiency for a diaphragm pump or the like. Current diaphragm pumps, as well as other pneumatic devices, experience two problems: (1) icing which results in reduced/erratic performance of the pump, and (2) inefficiency resulting from oversized valve porting to overcome icing provided in current design.

The air motor valving used to control reciprocating motion in current designs handles both the feed air to the driving piston or diaphragm and exhaust air through the same porting. In order to obtain fast switch over and high average output pressure it is important the piston/diaphragm chambers are exhausted as quickly as possible. In order for this to occur the porting through the valve is made as large as possible. The large port area allows the air to exhaust rapidly however; in doing so large temperature drops are generated in the valve. Any water in the air will drop out and freeze. As with most valves the geometry of the flow path through the valve may contain areas where the flow may be choked followed by large expansions and stagnation areas. These are the areas where water collects and freezes.

The valving itself may also become extremely cold since exhaust air is continually flowing through the valve and may cause water in the incoming air to freeze.

The large port area required to dump the exhaust is also used to feed the air chamber. During the fill cycle the large porting allows the chamber to fill rapidly and reach a high mean effective pressure in the chamber at high cycle rates. The head pressures developed at high flow rates are relatively low which requires a finite chamber pressure and volume to move the fluid at the required flow rate and head. By sizing the inlet porting to meet flow requirements the volume of air required is reduced as well as the amount to exhaust.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a reduced icing air valve including a reduced icing air valve comprising a shiftable valve for alternatively supplying compressed air through first and second supply ports to opposed first and second actuating chambers respectively and for effecting alternating exhaust of the chambers; the valve being further provided with bypass means intermediate the valve and each of the chambers for bypassing the valve by exhaust air.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

According to the present invention, in order to exhaust the air chambers rapidly without increasing the fill cycle porting, an alternate flow path is required.

Figure 1:
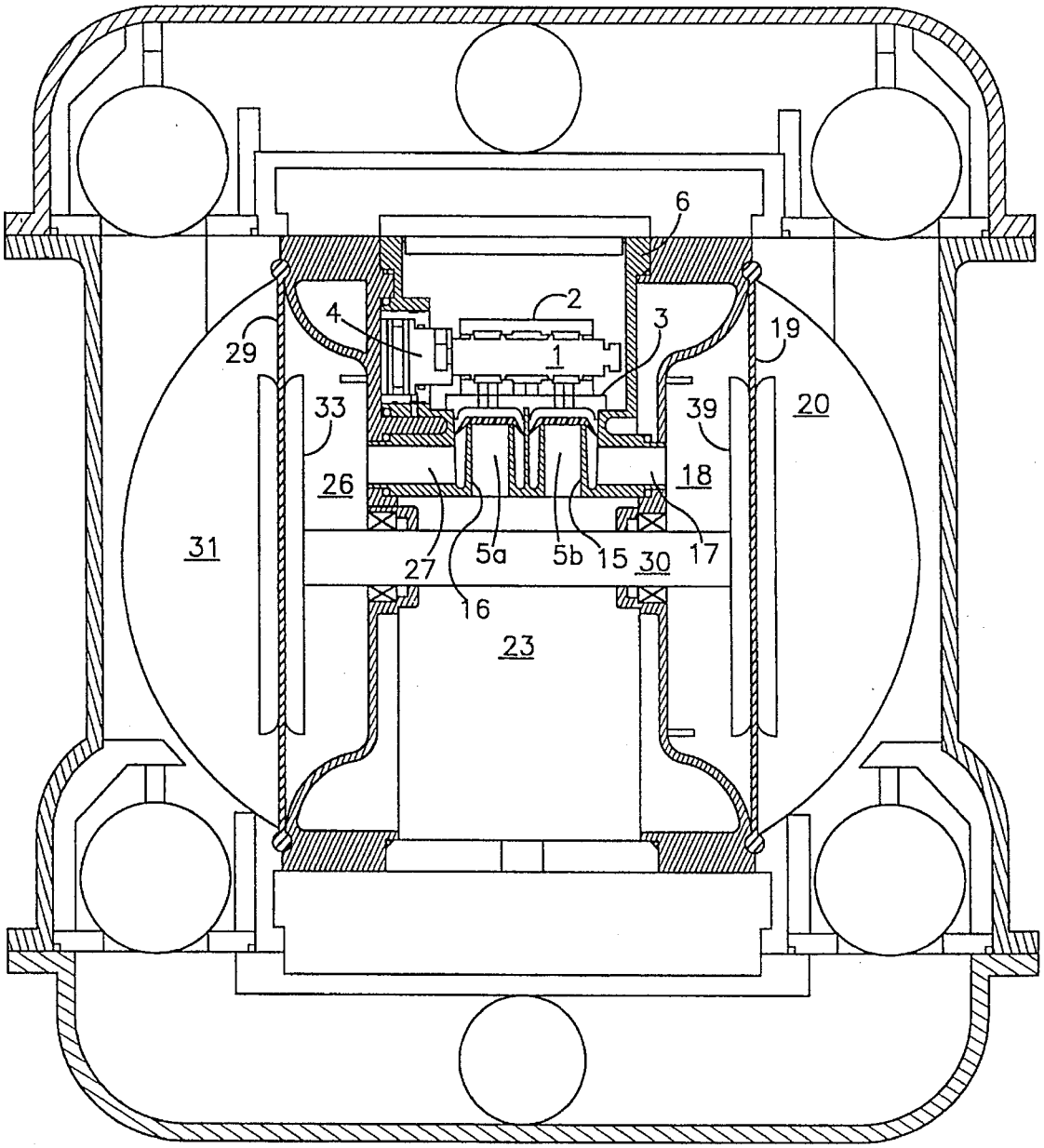
FIG. 1 is a cross section of a diaphragm pump showing an air motor major valve according to the present invention.
Figure 2:
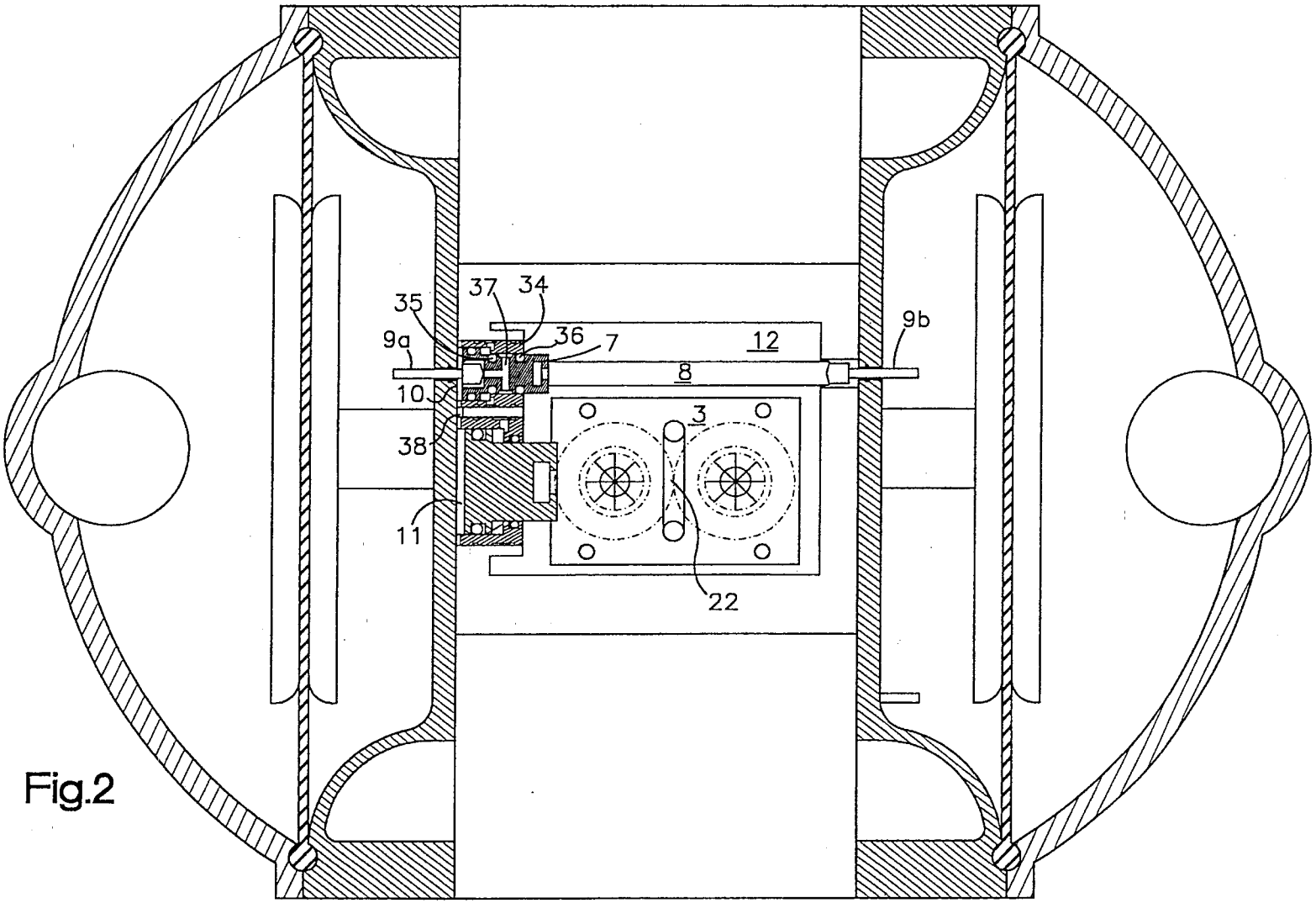
FIG. 2 is a cross section of a reduced icing air valve according to the present invention showing the pilot valve.

FIG. 1 is a cross sectional view of the air motor major valve. FIG. 2 is a view of the pilot valve. Both valves are shown in dead center position.

Figure 5:
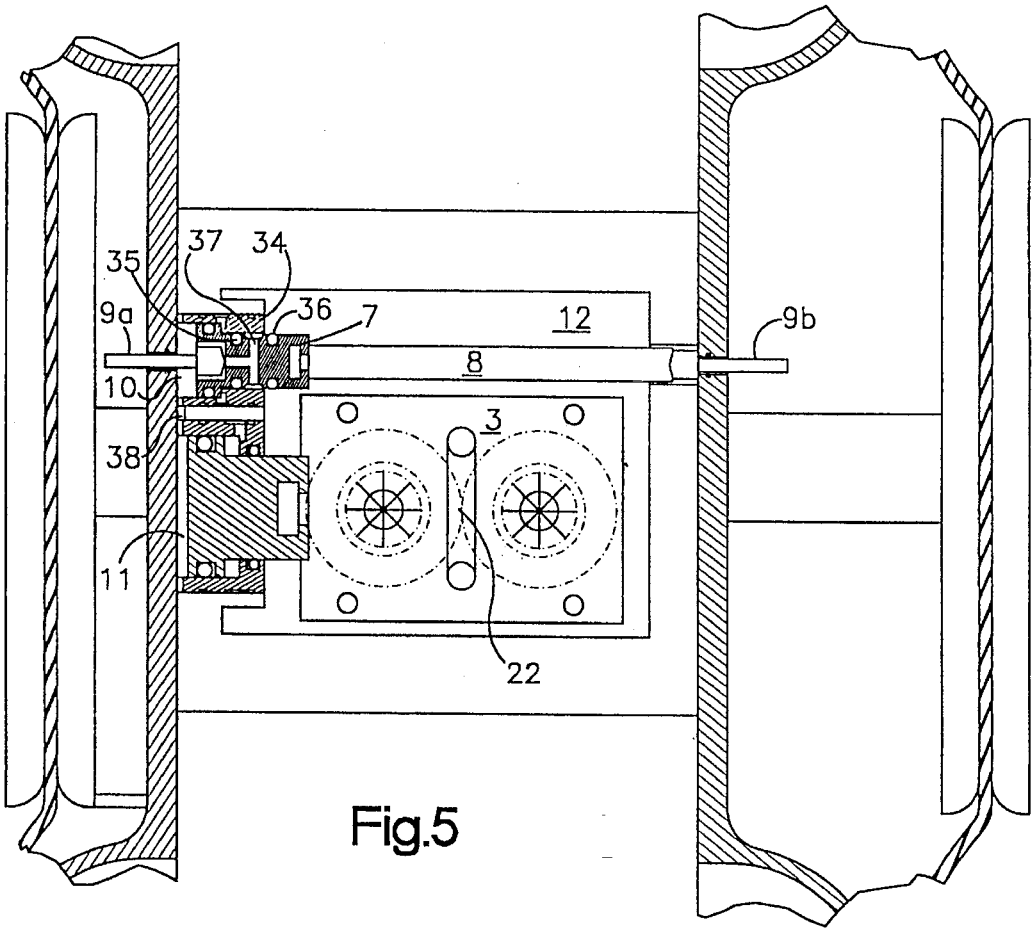
FIG. 5 is a cross section detail showing the pilot valve in the extreme right hand position.
Figure 6:
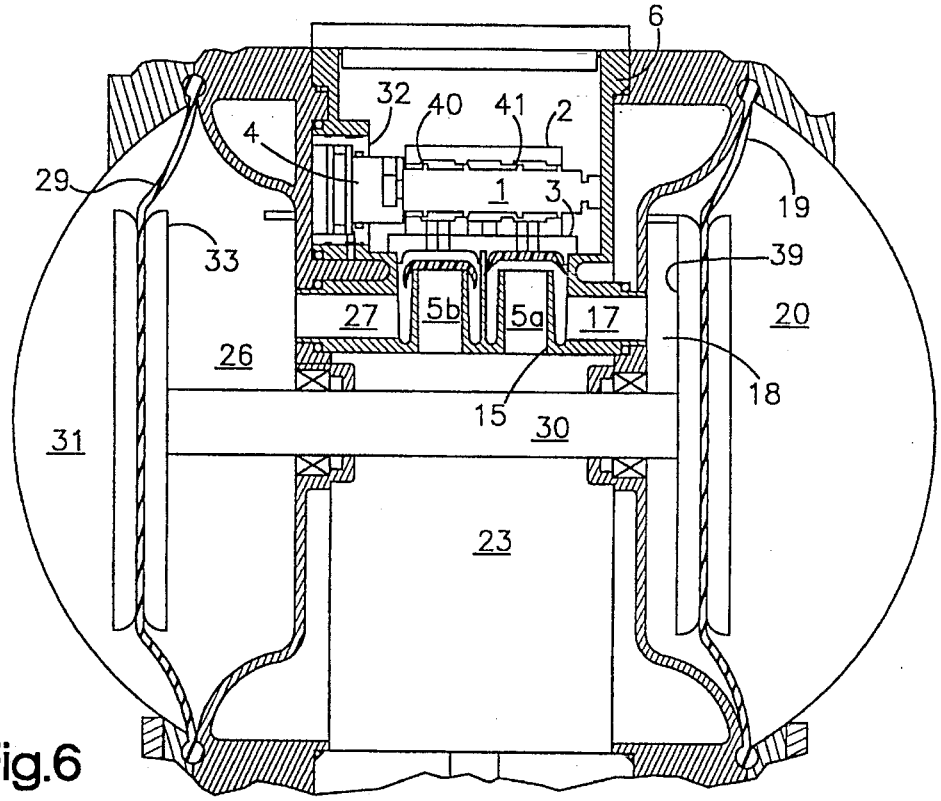
FIG. 6 is a cross section detail showing the major valve in the extreme right hand position.

In FIG. 1, the major valve consists of a spool 1, valve block 2, valve plate 3, power piston 4, quick dump or bypass check valves **5*a* and 5*b*, and housing 6. FIG. 2 shows the pilot consisting of pilot piston 7, pushrod 8 and actuator pins 9*a* and 9*b*. Both valves are located in the same cavity 12 which is pressurized with supply air. The power piston 4 and pilot piston 7 are differential pistons. Air pressure acting on the small diameters of the pistons will force the pistons to the left when pilot signal is not present in chambers 10 and 11. The area ratio from the large diameter to the small diameter is approximately 2:1. When the pilot signal is present in chambers 10 and 11 the pistons are forced to the right as shown in FIGS. 5 and 6**.

Figure 3:
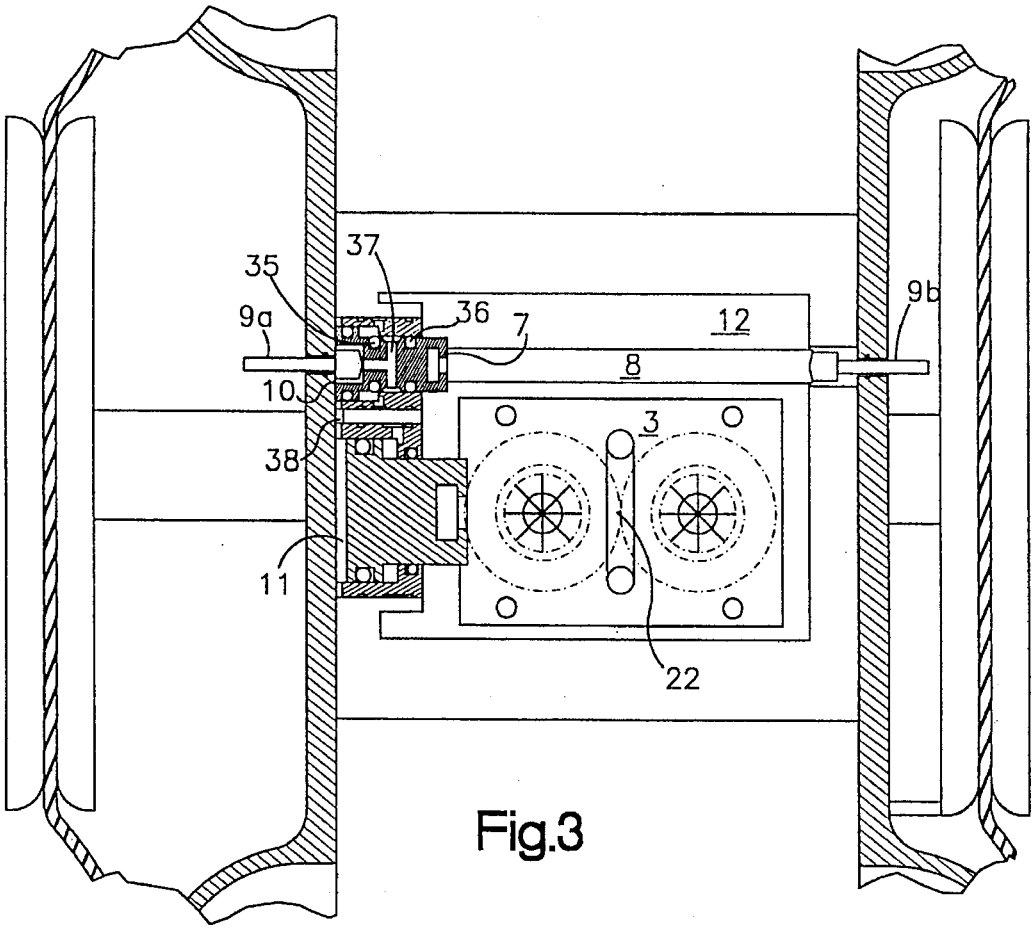
FIG. 3 is a cross section detail showing the pilot valve according to the present invention in the extreme left position.
Figure 4:
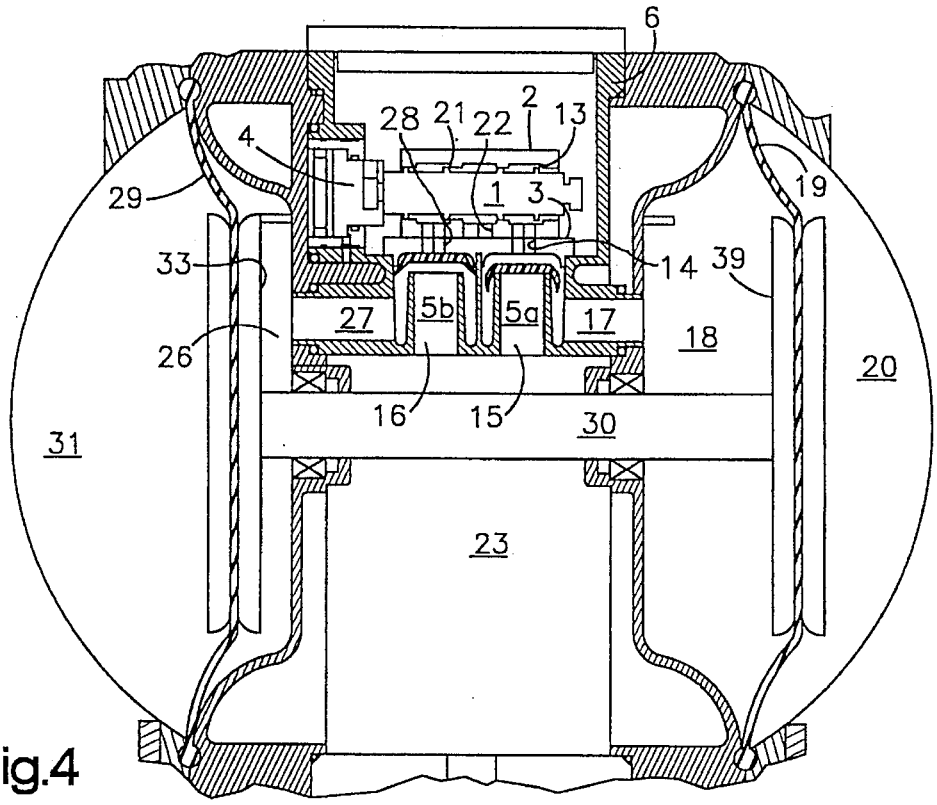
FIG. 4 is a cross section detail showing the air motor major valve spool in the extreme left hand position.

In FIG. 4 the spool 1 is shown in its extreme left position as is pilot piston 7 in FIG. 3. Air in cavity 12 flows through orifice 13 created between spool 1 and valve block 2 through port 14 in valve plate 3. The air impinging on the upper surface of check **5*a* forces it to seat and seal off exhaust port 15. The air flow deforms the lips of the elastomeric check as shown in FIG. 4. Air flows around the valve into port 17 and into diaphragm chamber 18. Air pressure acting on the diaphragm 19 forces it to the right expelling fluid from the fluid chamber 20** through an outlet check valve.

Operation of the fluid check valves controls movement of fluid in and out of the fluid chambers causing them to function as single acting pumps. By connecting the two chambers through external manifolds output flow from the pump becomes relatively constant.

At the same time chamber 18 is filling, the air above valve **5*b* has been exhausted through orifice 21, port 22 and into exhaust cavity 23. This action causes a pressure differential to occur between chambers 24 and 25. The lips of valve 5*b* relax against the wall of chamber 25. As air begins to flow from air chamber 26 through port 27, it forces valve 5*b* to move upward and seats against valve plate 3 and seal off port 28 and opens port 16. Exhaust air is dumped into cavity 23**.

Diaphragm 19 is connected to diaphragm 29 through shaft 30 which causes them to reciprocate together. As diaphragm 19 traverses to the right diaphragm 29 creates a suction on fluid chamber 31 which causes fluid to flow into fluid chamber 31 through an inlet check. As the diaphragm assembly approaches the end of the stroke, diaphragm washer 33 pushes actuator pin **9*a* (FIG. 5) to the right. The pin in turn pushes pilot piston 7 to the right to the position shown in FIG. 5. O-ring 35 is engaged in bore of sleeve 34** and O-ring 36 exits the bore to allow air to flow from air cavity 12 through port 37 in pilot piston 7 and into cavity 10. Air pressure acting on the large diameter of pilot piston 7 causes the piston to shift to the right.

The air that flows into chamber 10 also flows into chamber 11 through passage 38 which connects the two bores. When the pressure reaches approximately 50% of supply pressure, the power piston 4 shifts spool 1 to the position shown in FIG. 6. Air being supplied to chamber 18 is shut off and chamber 38 is exhausted through orifice 41. This causes valve 5*a* to shift connecting air chamber 18 to exhaust port 15. At the same time air chamber 26 is connected to supply air through orifice 40 and port 28 and 27. The air pressure acting on diaphragm 29 causes the diaphragms to reverse direction expelling fluid from fluid chamber 31 through the outlet check while diaphragm 19 evacuates fluid chamber 20 to draw fluid into fluid chamber 20.

As diaphragm 19 approaches the end of its stroke, diaphragm washer 39 pushes actuator pin 9*b*. The motion is transmitted through pushrod 8 to pilot piston 7 moving it to the trip point shown in FIG. 2. O-ring 36 reenters the bore in sleeve 34 and seals off the air supply to chambers 10 and 11. O-ring 35 exits the bore to connect chambers 10 and 11 to port 37 in pilot piston 7. The air from the two chambers flows through port 42 into exhaust cavity 23. Air in air cavity 12 acting on the small diameters of pistons 4 and 7 forces both to the left as shown in FIGS. 3 and 4. The power piston 4 will pull spool 1 to the left to begin a new cycle.

Different arrangements to actuate the quick dump valves can be used which include poppet valves, "D" valves and other mechanical or pneumatically actuated valves.

Having described our invention in terms of a preferred embodiment, we do not wish to be limited in the scope of our invention except as claimed.

What is claimed is:

1. A reduced icing air valve for an air motor comprising:

a shiftable valve having a pilot piston for shifting said valve for alternatively supplying compressed air through first and second supply ports to opposed first and second power pistols in opposed air motor chambers respectively and for effecting alternating exhaust of said chambers;

said shiftable valve being further provided with bypass means independent of and intermediate said shiftable valve and each of said first and second air motor chambers for bypassing said shiftable valve by exhaust air from said air motor chambers: said bypass means being furthest actuated in an opposing direction by a source of supply air to said chambers.

2. A reduced icing valve according to claim 1 wherein:

said bypass means further comprises a pressure operated check valve closed to exhaust by the supply of compressed air to an associated air motor chamber and open to exhaust thereby permitting return flow of exhaust air from said associated actuating chamber to bypass said shiftable valve, upon ceasing the supply of compressed air.

3. A reduced icing valve according to claim 2 wherein:

said pressure operated check valve further comprises a deformable elastomeric check coacting with an exhaust port to close said exhaust port upon supply of compressed air and coacting with a supply port to close off said supply port to said shiftable valve upon exhaust of said associated air motor chamber.

4. A reduced icing air valve for a reciprocating double diaphragm pump comprising:

a shiftable valve having a pilot piston for shifting said valve for alternatively supplying compressed air through first and second supply ports to opposed first and second opposed diaphragm actuating chambers respectively and for effecting alternating exhaust of said chambers;

said shiftable valve being further provided with bypass means independent of and intermediate said shiftable valve and each of said first and second diaphragm actuating chambers for bypassing said shiftable valve by exhaust air from said diaphragm actuating chambers, said bypass means being further actuated in an opposing direction by a source of supply air said chamber.

5. A reduced icing air valve for a reciprocating double diaphragm pump according to claim 4 wherein: said shiftable valve further comprises a pneumatically operated spool valve.

6. A reduced icing air valve for a reciprocating double diaphragm pump according to claim 4 wherein: said opposed first and second diaphragm actuating chambers comprise diaphragm operating chambers for mechanically connected diaphragms wherein pressurization of one of said opposed first and second diaphragm actuating chambers effects exhaust of the other of said opposed first and second diaphragm actuating chambers.

7. A reduced icing air valve for a reciprocating double diaphragm pump according to claim 6 wherein:

said bypass means further comprises a pressure operated check valve closed to exhaust by the supply of compressed air to an associated diaphragm actuating chamber and open to exhaust thereby permitting return flow of exhaust air from said associated diaphragm actuating chamber to bypass said shiftable valve, upon ceasing the supply of compressed air.

8. A reduced icing air valve for a reciprocating double diaphragm pump according to claim 7 wherein:

said pressure operated check valve further comprises a deformable elastomeric check coacting with an exhaust port to close said exhaust port upon supply of compressed air and coacting with a supply port to close off said supply port to said shiftable valve upon exhaust of said diaphragm actuating chamber.

9. A reduced icing air valve for a reciprocating double diaphragm pump according to claim 8 wherein:

said exhaust port exits to atmosphere.

10. A reduced icing air valve for a reciprocating double diaphragm pump according to claim 7 wherein:

said pressure operated check valve further coacts with the respective supply port to prevent return flow of exhaust air to said shiftable valve.

* * * * *